US011821438B2

(12) United States Patent
Tanaka et al.

(10) Patent No.: US 11,821,438 B2
(45) Date of Patent: Nov. 21, 2023

(54) FAN UNIT

(71) Applicant: DAIKIN INDUSTRIES, LTD., Osaka (JP)

(72) Inventors: Shuuichi Tanaka, Osaka (JP); Akira Komatsu, Osaka (JP); Tooru Fujimoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/127,415

(22) Filed: Mar. 28, 2023

(65) Prior Publication Data

US 2023/0296110 A1 Sep. 21, 2023

Related U.S. Application Data

(63) Continuation of application No. PCT/JP2021/035870, filed on Sep. 29, 2021.

(30) Foreign Application Priority Data

Sep. 30, 2020 (JP) ..... 2020-165350

(51) Int. Cl.
*F04D 29/42* (2006.01)
*F04D 27/00* (2006.01)

(52) U.S. Cl.
CPC ..... *F04D 29/4226* (2013.01); *F04D 27/001* (2013.01)

(58) Field of Classification Search
CPC ..... F04D 29/4226; F04D 27/001
See application file for complete search history.

(56) References Cited

U.S. PATENT DOCUMENTS 6,186,744 B1 2/2001 Wolochuk
8,070,423 B2 * 12/2011 Vogel ..... F04D 25/0666 415/121.3

(Continued)

FOREIGN PATENT DOCUMENTS

JP 8-82299 A 3/1996
JP 6332932 B2 5/2018

(Continued)

OTHER PUBLICATIONS

International Preliminary Report of corresponding PCT Application No. PCT/JP2021/035870 dated Apr. 6, 2023.

(Continued)

*Primary Examiner* — Sabbir Hasan
(74) *Attorney, Agent, or Firm* — Global IP Counselors, LLP

(57) ABSTRACT

A fan unit includes a centrifugal fan, an air flow volume detector, and a main body casing housing the centrifugal fan and the air flow volume detector. The centrifugal fan includes a fan casing and a rotor. The air flow volume detector includes main body, and a probe that detects an air flow volume equivalent quantity equivalent to an air flow volume provided by the centrifugal fan. The fan casing includes a bell mouth defining an air inlet and having a convex surface. A distance from the probe to the surface of the bell mouth is larger than 0 and smaller than one third of a radius of the air inlet. A thermal air velocity sensor detects, as the air flow volume equivalent quantity, an air velocity of air flowing through the air inlet not connected to a duct by measuring an amount of heat dissipated from the probe.

9 Claims, 14 Drawing Sheets

(56) References Cited

U.S. PATENT DOCUMENTS

| | | | | |
|---|---|---|---|---|
| 8,366,377 | B2 * | 2/2013 | Smiley, III | G01F 1/36 415/118 |
| 2011/0217182 | A1 * | 9/2011 | Hanewald | G01F 1/34 417/1 |
| 2011/0250051 | A1 | 10/2011 | Smiley, III et al. | |
| 2018/0258943 | A1 * | 9/2018 | Horng | G01K 1/14 |

FOREIGN PATENT DOCUMENTS

| | | | |
|---|---|---|---|
| JP | 2019-167828 | A | 10/2019 |
| WO | 92/22790 | A1 | 12/1992 |

OTHER PUBLICATIONS

International Search Report of corresponding PCT Application No. PCT/JP2021/035870 dated Nov. 9, 2021.

* cited by examiner

FAN UNIT

CROSS-REFERENCE TO RELATED APPLICATIONS

This is a continuation of International Application No. PCT/JP2021/035870 filed on Sep. 29, 2021, which claims priority to Japanese Patent Application No. 2020-165350, filed on Sep. 30, 2020. The entire disclosures of these applications are incorporated by reference herein.

BACKGROUND

Technical Field

The present disclosure relates to a fan unit including a centrifugal fan that is housed in a main body casing.

Background Art

JP 2019-167828 A discloses a fan including an air velocity sensor disposed on a blow-out duct. An air flow volume provided by this fan is calculated from an air velocity and a sectional area of the blow-out duct, as an air flow volume passing through the blow-out duct.

SUMMARY

A fan unit, according to one or more embodiments, includes a centrifugal fan, an air flow volume detector, and a main body casing. The centrifugal fan includes a fan casing and a rotor disposed in the fan casing and rotatable about a shaft. The air flow volume detector includes a main body and a probe configured to detect an air flow volume-equivalent quantity that is equivalent to an air flow volume to be provided by the centrifugal fan. The main body casing houses the centrifugal fan and the air flow volume detector. The fan casing includes a bell mouth defining an air inlet through which air in the main body casing flows into the fan casing. The bell mouth has a surface drawing a convex curve toward the shaft as seen in a section taken along a plane covering the shaft. The main body is fixed to at least one of the fan casing or the bell mouth. The probe is located on a normal of the surface of the bell mouth in a direction toward which the surface of the bell mouth protrudes, and a distance from the probe to the surface of the bell mouth is larger than 0 and smaller than one-third of a radius of the air inlet.

DETAILED DESCRIPTION OF EMBODIMENT(S)

First Embodiment (1) General Configuration

Figure 1:
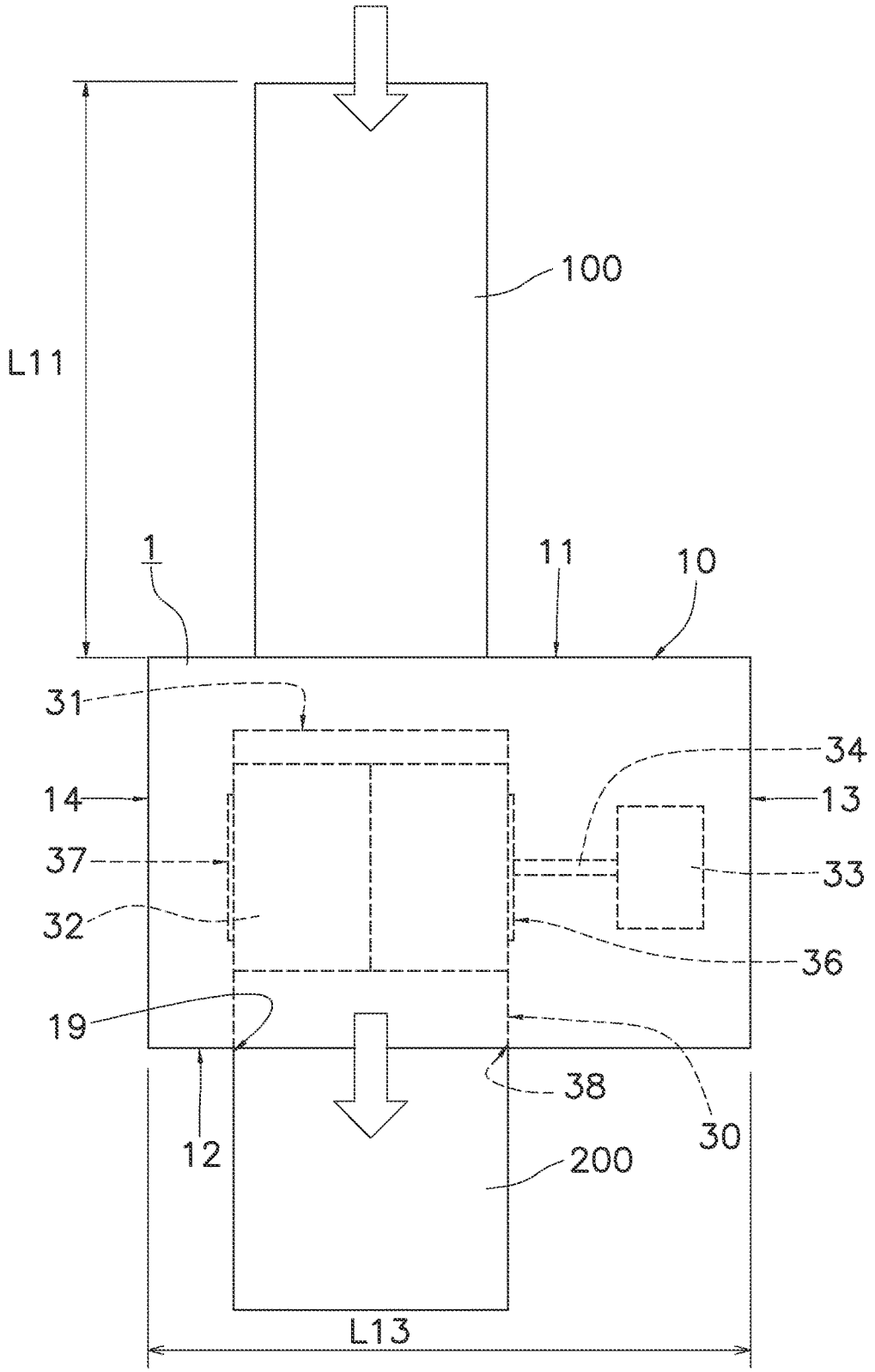
FIG. 1 is a schematic top view of a fan unit and a duct according to an embodiment.
Figure 2:
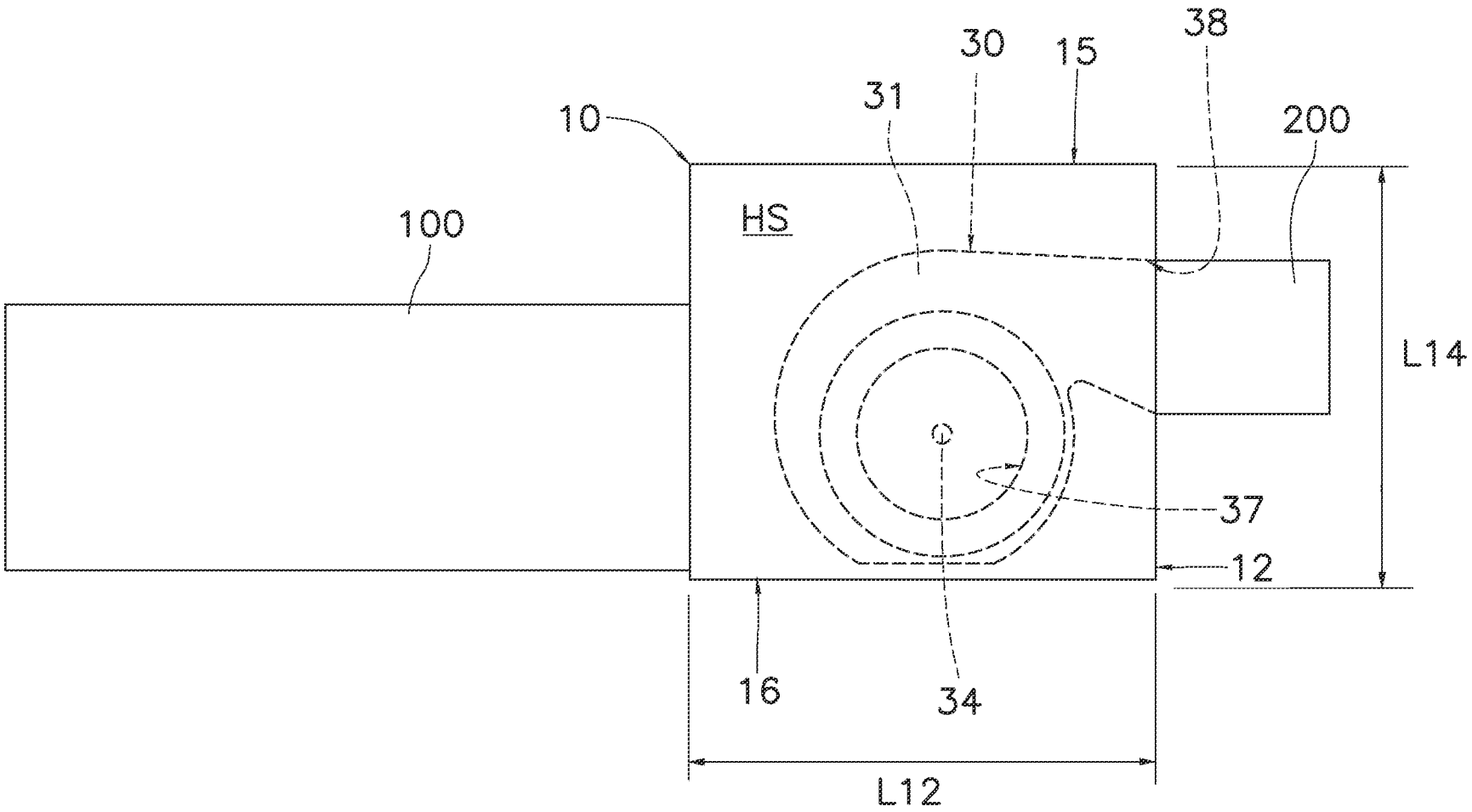
FIG. 2 is a schematic side view of the fan unit and the duct according to the embodiment.

As illustrated in FIGS. 1 and 2, a fan unit 1 is, in use, connected to, for example, a first duct 100 and a second duct 200. FIG. 1 is a top view of the fan unit 1, the first duct 100, and the second duct 200. FIG. 2 is a side view of the fan unit 1, the first duct 100, and the second duct 200. The fan unit 1 is configured to provide air from the first duct 100 to the second duct 200. Each of the first duct 100 and the second duct 200 illustrated in FIGS. 1 and 2 is a round duct. Accordingly, each of the first duct 100 and the second duct 200 has a circular sectional shape taken along a plane orthogonal to a flow path.

The fan unit 1 includes a main body casing 10. The main body casing 10 has a rectangular parallelepiped-base shape. The main body casing 10 has first to sixth faces 11 to 16 that define a housing space HS (see FIGS. 1 to 4). The first duct 100 is connected to the first face 11. The first face 11 has an opening to which the first duct 100 is connected, and this opening serves as an intake port 18 (see FIGS. 3 and 4) of the main body casing 10. The second duct 200 is connected to the second face 12. The second face 12 has an opening to which the second duct 200 is connected, and this opening serves as a blow-out port 19 (see FIG. 1) of the main body casing 10. In the fan unit 1 illustrated in FIGS. 1 and 2, the first face 11, second face 12, third face 13, and fourth face 14 define side surfaces of the main body casing 10, the fifth face 15 defines a top surface of the main body casing 10, and the sixth face 16 defines a bottom surface of the main body casing 10. For convenience of the description, the fifth face 15 is regarded as the top surface, and the sixth face 16 is regarded as the bottom surface. However, the first to sixth faces 11 to 16 are not necessarily oriented as illustrated in FIGS. 1 and 2. The orientation of the first to sixth faces 11 to 16 of the fan unit 1 is appropriately set in use.

Figure 3:
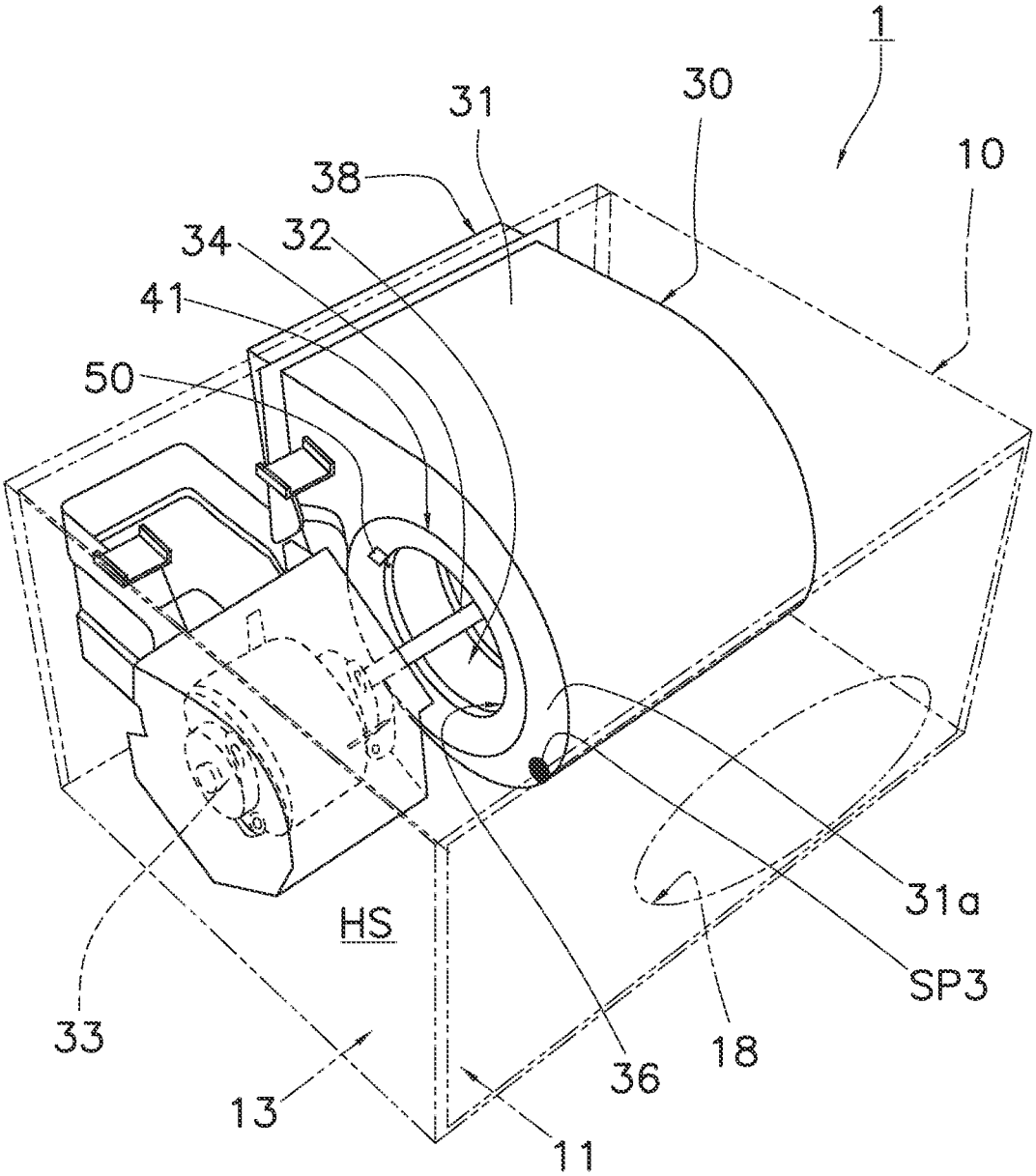
FIG. 3 is a perspective view of a centrifugal fan and an air flow volume detector in a main body casing of the fan unit.
Figure 4:
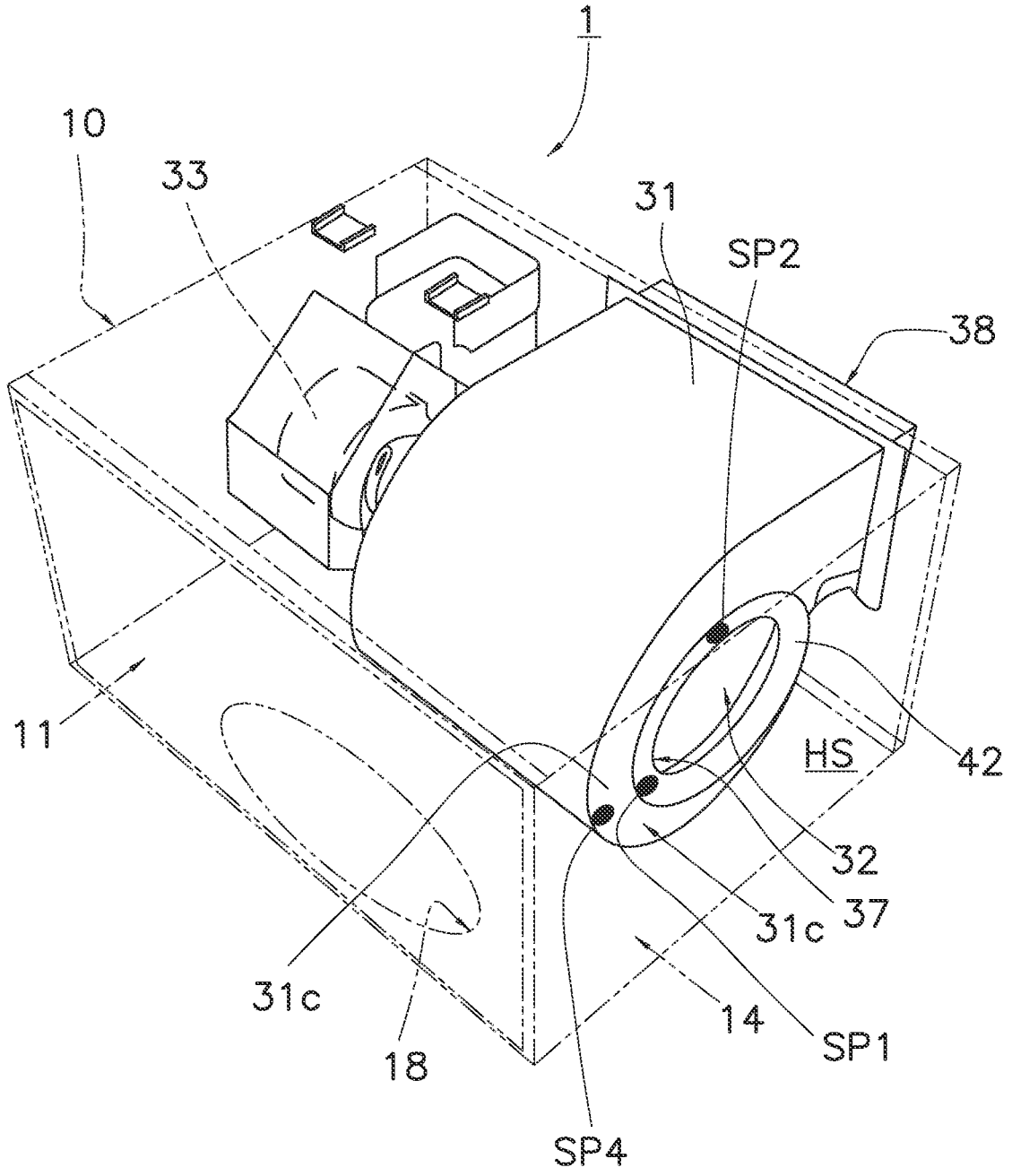
FIG. 4 is a perspective view of the centrifugal fan in the main body casing of the fan unit.

The fan unit 1 also includes a centrifugal fan 30. The centrifugal fan 30 for use in the fan unit 1 is, for example, a sirocco fan. The centrifugal fan 30 is housed in the main body casing 10. FIGS. 3 and 4 each illustrate the centrifugal fan 30 housed in the housing space HS in the main body casing 10. The centrifugal fan 30 includes a fan casing 31 and a rotor 32. The fan casing 31 has a first air inlet 36, a second air inlet 37, and an air outlet 38. The rotor 32 is disposed in the fan casing 31. The rotor 32 includes a plurality of blades; however, FIG. 3 and FIG. 4 do not illustrate the blades of the rotor 32. The rotor 32 rotates in the fan casing 31, so that the centrifugal fan 30 takes in air through the first air inlet 36 and the second air inlet 37, and blows out the air through the air outlet 38. The fan casing 31 includes a first bell mouth 41 defining the first air inlet 36, and a second bell mouth 42 defining the second air inlet 37. In the housing space HS, the air outlet 38 of the centrifugal fan 30 communicates with the opening in the second face 12 of the main body casing 10. Also in the housing space HS, the first air inlet 36 of the centrifugal fan 30 faces the third face 13, and the second air inlet 37 of the centrifugal fan 30 faces the fourth face 14.

The fan unit 1 also includes an air flow volume detector 50 configured to detect an air flow volume-equivalent quantity that is equivalent to an air flow volume to be provided by the centrifugal fan 30. An air flow volume-equivalent quantity refers to a physical quantity that can be converted into an air flow volume. The air flow volume-equivalent quantity is, for example, an air velocity. For example, a relationship between an air velocity and an air flow volume to be detected by the air flow volume detector 50 of the fan unit 1 is calculated in advance by experiment or simulation so as to convert, into an air flow volume, an air velocity of air to be provided by the fan unit 1 to which the air flow volume detector 50 is mounted. In order to convert an air velocity of the fan unit 1 into an air flow volume, for example, a relational expression between an air velocity and an air flow volume may be established in advance or a conversion table for converting an air velocity into an air flow volume may be prepared in advance. The air flow volume detector 50 is housed in the main body casing 10. In other words, the air flow volume detector 50 is placed in the housing space HS. The air flow volume detector 50 is placed on the first bell mouth 41 in order to accurately detect an air flow volume. This embodiment exemplifies the case where the air flow volume detector 50 is placed on the first bell mouth 41. Alternatively, the air flow volume detector 50 may be placed on the second bell mouth 42. Still alternatively, air flow volume detectors 50 may respectively be placed on the first bell mouth 41 and the second bell mouth 42. The case where the air flow volume detector 50 is placed on at least one of the first bell mouth 41 or the second bell mouth 42 enables accurate air flow volume detection as compared with, for example, a case where the air flow volume detector 50 is placed on a place different from the first bell mouth 41 and the second bell mouth 42, such as an outer surface of the fan casing 31 or an inner surface of one of the first to sixth faces 11 to 16 of the main body casing 10.

(2) Specific Configuration (2-1) Air Flow Volume Detector 50

Figure 5:
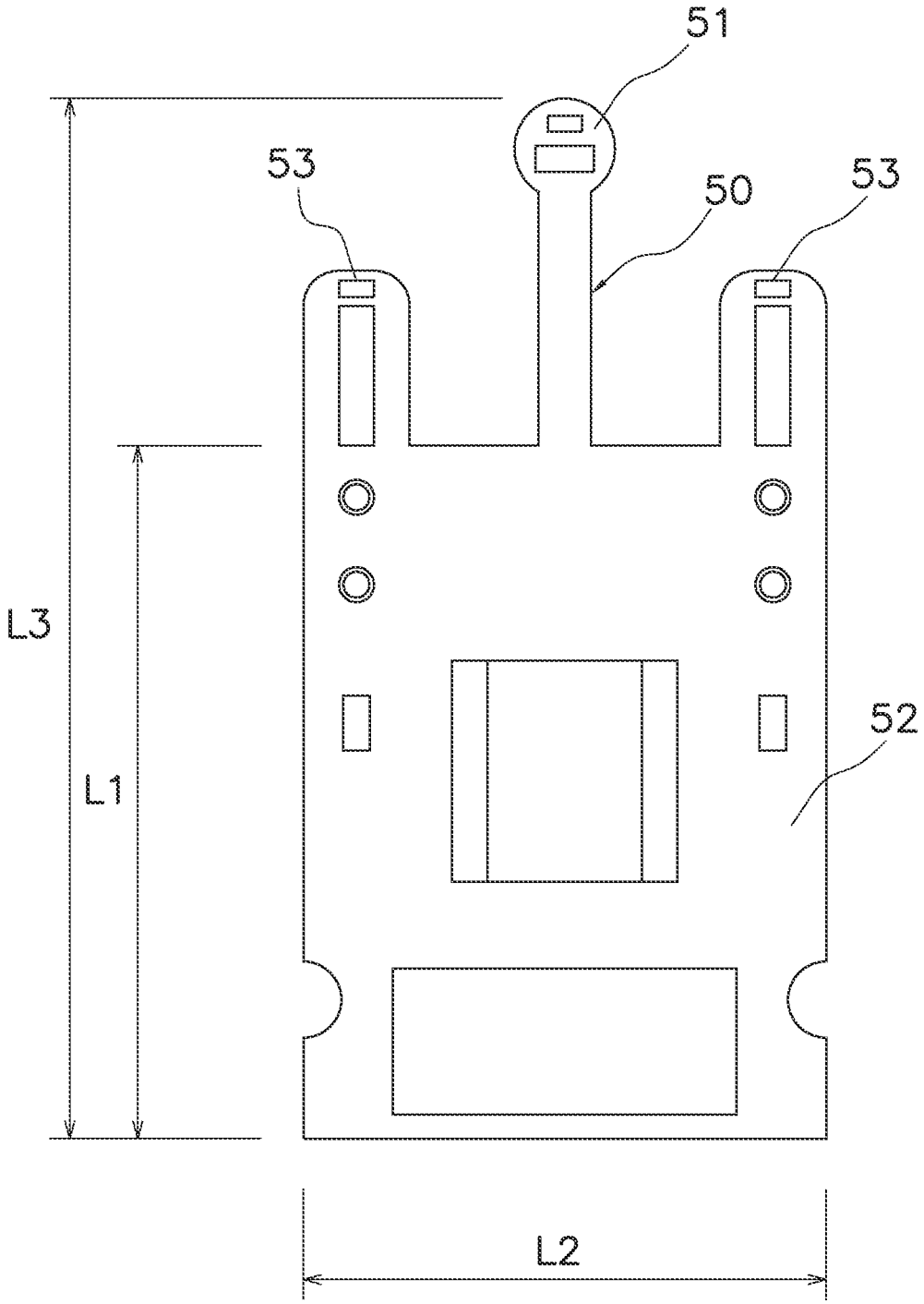
FIG. 5 is a plan view of an example of the air flow volume detector.

FIG. 5 illustrates a thermal air velocity sensor which is an example of the air flow volume detector 50. The air flow volume detector 50 includes a probe 51, a main body 52, and two temperature measurement units 53. The probe 51 of the air flow volume detector 50 includes a heat generator and a temperature sensor. An amount of heat dissipated from the probe 51 varies depending on a velocity of air passing through the probe 51. The air flow volume detector 50 measures the amount of dissipated heat to detect the air velocity. This embodiment exemplifies a case where an amount of dissipated heat is converted into an air velocity and the air velocity is then converted into an air flow volume. The air flow volume detector 50 may alternatively be configured to directly convert an amount of dissipated heat into an air flow volume. In this case, the amount of dissipated heat corresponds to an air flow volume-equivalent quantity.

The probe 51 is disposed on a distal end of an elongate portion extending from a rectangular portion of the main body 52. The rectangular portion of the main body 52 is formed of a rectangular plate having a longitudinal length L1 and a lateral length L2. The longitudinal length L1 is, for example, 20 mm while the lateral length L2 is, for example, 15 mm. The air flow volume detector 50 including the probe 51 has a longitudinal length L3 of, for example, 30 mm.

The temperature measurement units 53 are located side by side with the probe 51 in between. Each temperature measurement unit 53 is configured to measure a temperature of air passing through the probe 51. An air temperature may vary an amount of heat to be dissipated from the probe 51 even at a fixed air velocity. The air flow volume detector 50 therefore compensates for a value of an air flow volume to be detected by the air flow volume detector 50, with a temperature.

(2-2) Centrifugal Fan 30

The centrifugal fan 30 also includes a fan motor 33 disposed outside the fan casing 31 and configured to drive and rotate the rotor 32. The fan motor 33 and the rotor 32 are coupled together with a shaft 34. The shaft 34 extends from the third face 13 to the fourth face 14 of the main body casing 10. The rotor 32 rotates about the shaft 34. The fan motor 33 is located nearer to the third face 13 than to the fourth face 14 of the main body casing 10. The fan casing 31 is located nearer to the fourth face 14 than the fan motor 33 is. The fan casing 31 is located closer to the fourth face 14 with respect to a midpoint between the third face 13 and the fourth face 14. Therefore, the first duct 100 and the second duct 200 are also located nearer to the fourth face 14 than to the third face 13.

(2-3) Placement Position of Air Flow Volume Detector 50

The probe 51 of the air flow volume detector 50 is placed in a current of air that flows into the main body casing 10 through the intake port 18 and then flows into the centrifugal fan 30 through the first air inlet 36. Therefore, the main body 52 of the air flow volume detector 50 is fixed to the fan casing 31. This embodiment exemplifies the case where the main body 52 is fixed to the fan casing 31. Alternatively, the main body 52 may be fixed to the first bell mouth 41. Still alternatively, the main body 52 may be fixed to both the fan casing 31 and the first bell mouth 41.

Figure 6:
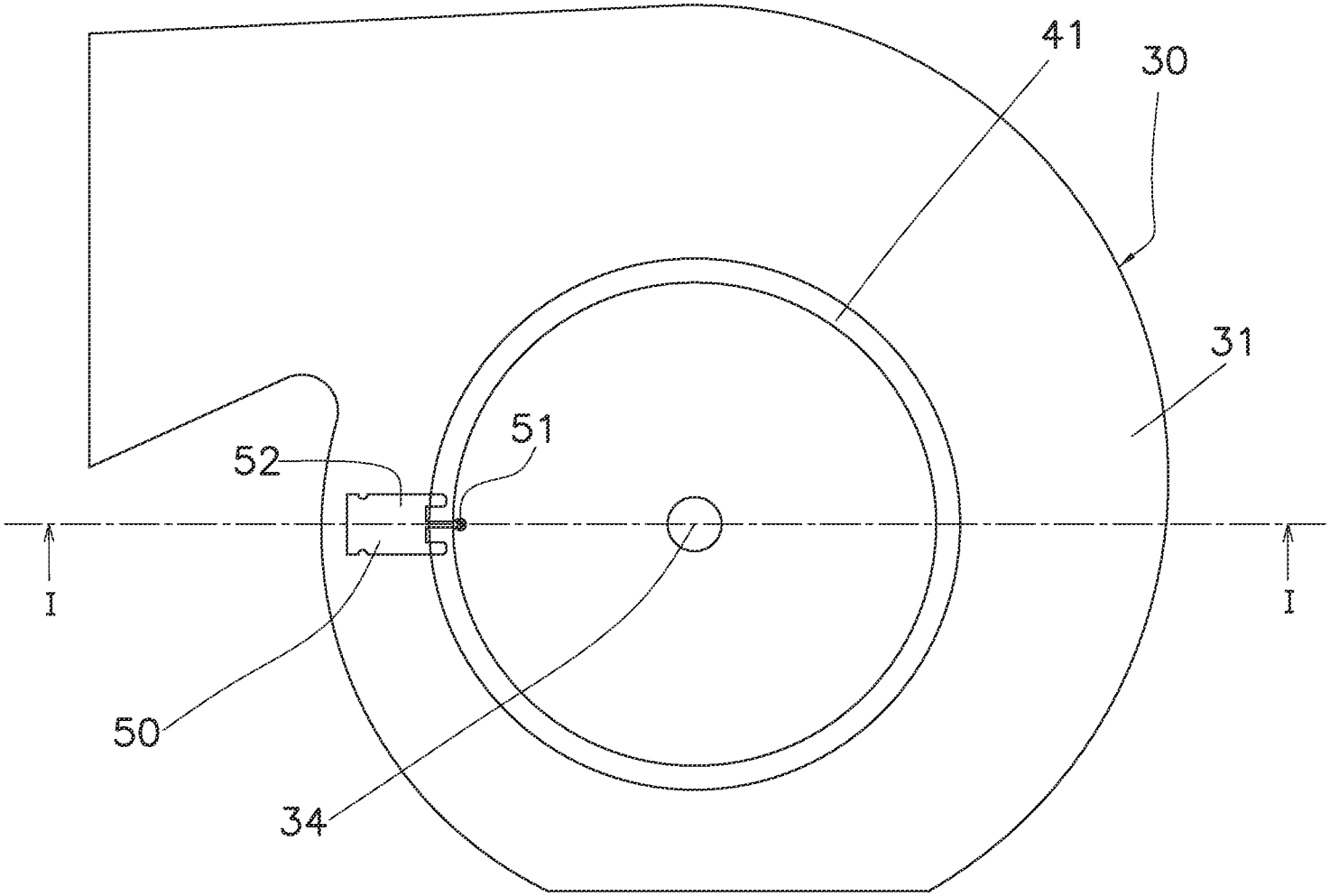
FIG. 6 is a schematic side view of the centrifugal fan, which illustrates a placement position of the air flow volume detector.
Figure 7:
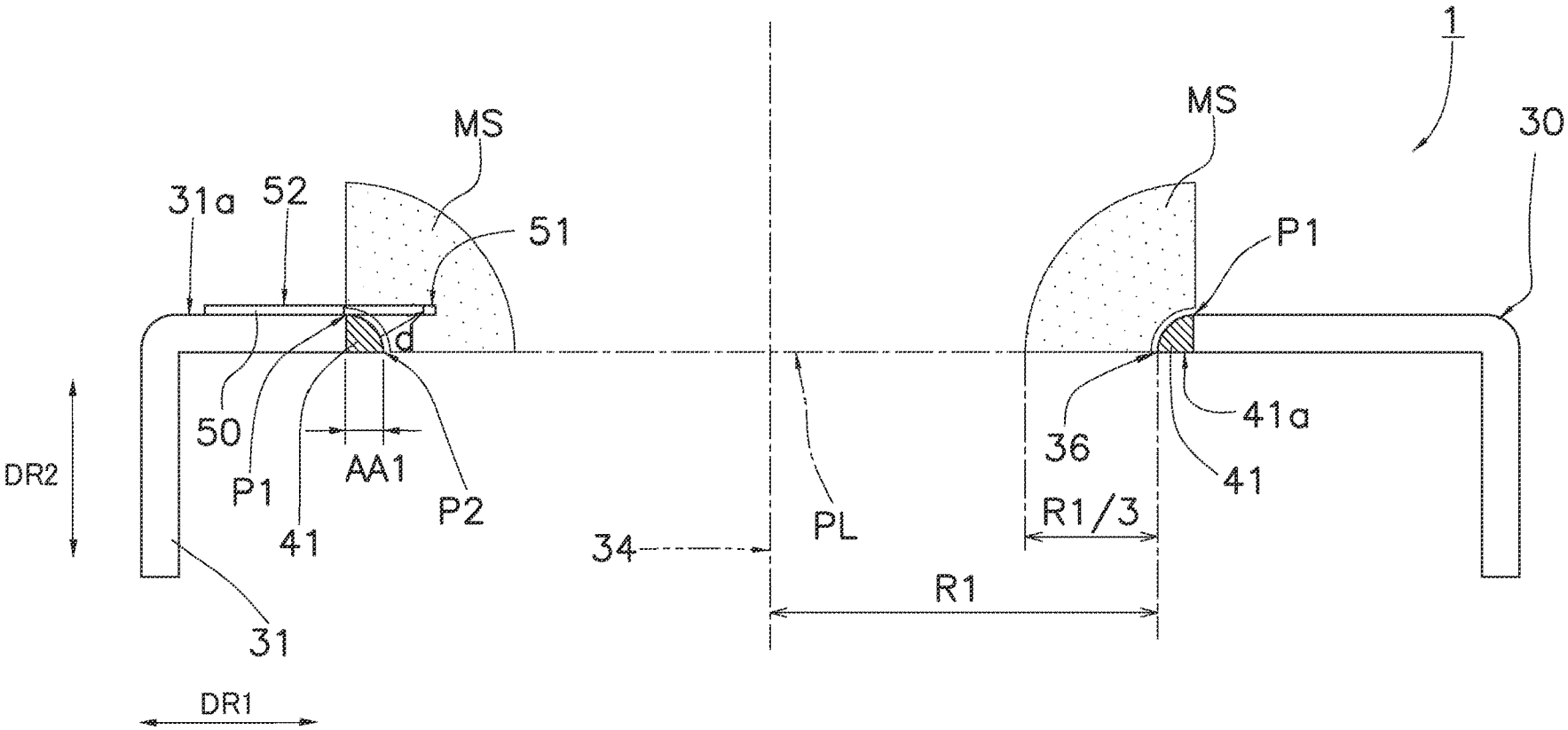
FIG. 7 is a schematic sectional view of a part of the centrifugal fan, which is taken along line I-I in FIG. 6.

FIGS. 6 and 7 each illustrate the first bell mouth 41 on which the air flow volume detector 50 is placed. FIG. 7 is a schematic sectional view of a part of the fan casing 31, which is taken along line I-I in FIG. 6. FIG. 7 also illustrates a section of the first bell mouth 41 taken along a plane covering the shaft 34. As illustrated in FIG. 7, the first bell mouth 41 has a surface drawing a convex curve toward the shaft 34. More specifically, the surface of the first bell mouth 41 draws a convex arc toward the shaft 34. This embodiment exemplifies the surface of the first bell mouth 41 drawing the convex arc; however, a curve to be drawn by the surface of the first bell mouth 41 is not limited to an arc. The surface of the first bell mouth 41 extends inward of the fan casing 31 from a first surface 31*a* of the fan casing 31 as a distance from the surface of the first bell mouth 41 to the shaft 34 becomes shorter, and reaches the first air inlet 36.

In FIG. 7, a first direction DR1 indicates a direction perpendicular to the shaft 34 in the section of the fan casing 31. Also in FIG. 7, a region AA1 indicates a region between the first air inlet 36 and a position P1 at which the first bell mouth 41 is curved inward of the fan casing 31. The region AA1 has an outer side extending to the position P1 and an inner side extending to a position P2 illustrated in FIG. 7. The position P2 is at a boundary between the first bell mouth 41 and the first air inlet 36, and is on an inner periphery of the surface of the first bell mouth 41. In the first direction DR1, the probe 51 is located within a range from the position P1 at which the first bell mouth 41 is curved inward of the fan casing 31 to a position corresponding to one-third of a radius R1 of the first air inlet 36. The air flow volume detector 50 is placed such that the main body 52 at least partially overlaps the region AA1 as seen along an axis of the shaft 34 (i.e., as seen in a second direction DR2 illustrated in FIG. 7). The main body 52 thus placed is fixed to the outer surface, that is, the first surface 31*a* of the fan casing 31. In this embodiment, the main body 52 is partially fixed to the first surface 31*a*. Alternatively, the entire main body 52 may be fixed to the first surface 31*a* as long as the probe 51 is located in a measurement space MS.

The main body 52 is placed in the region AA1 since the probe 51 is placed in the measurement space MS as illustrated in FIG. 7. In FIG. 7, the measurement space MS is hatched with dots. The measurement space MS extends in the direction toward which the surface of the first bell mouth 41 draws the convex curve, on a normal of the surface of the first bell mouth 41. A given point in the measurement space MS has a distance d from the given point to the surface of the first bell mouth 41, and the distance d is larger than 0 and smaller than one-third of the radius R1 of the first air inlet 36. A second plane PL covers an inner face 41*a* of the first bell mouth 41 and extends perpendicularly to the shaft 34. The inner face 41*a* of the first bell mouth 41 belongs to an inner face of the fan casing 31 and is located within the region AA1. The measurement space MS extends within a range that covers a part of the second plane PL and is farther from the rotor 32 than from the second plane PL, as seen in the first direction DR1. A distance from a farther end edge of the measurement space MS from the rotor 32 to the position P1 is shorter than a length corresponding to one-third of the radius R1 of the first air inlet 36, as seen in the first direction DR1. The position P1, at which the first bell mouth 41 is curved inward of the fan casing 31, is on a top portion of the first bell mouth 41. The measurement space MS is limited within a range that is nearer to the shaft 34 than the position P1, at which the first bell mouth 41 is curved inward of the fan casing 31, is and is separate from the shaft 34 by a length corresponding to two-third of the radius R1 of the first air inlet 36, as seen in the second direction DR2. The position P1, at which the first bell mouth 41 is curved inward of the fan casing 31, is on an outer periphery of the first bell mouth 41. As illustrated in FIG. 7, therefore, the measurement space MS is a donut-shaped space limited within a range from a position inward of the outer periphery of the first bell mouth 41 to a position inward of an inner periphery of the first bell mouth 41 by the length corresponding to one-third of the radius R1, as seen in the second direction DR2. In addition, the measurement space MS is limited to a space separate from the first bell mouth 41. The distance d from the surface of the first bell mouth 41 to the measurement space MS is larger than 0 and is, for example, 1 mm. Placing the probe 51 at a spot separate from the first bell mouth 41 by 1 mm or more enables accurate conversion from an air velocity into an air flow volume. As illustrated in FIG. 7, the measurement space MS has a shape of two sectors in the vicinity of the first bell mouth 41, as seen in the section taken along the plane covering the shaft 34.

Figure 8:
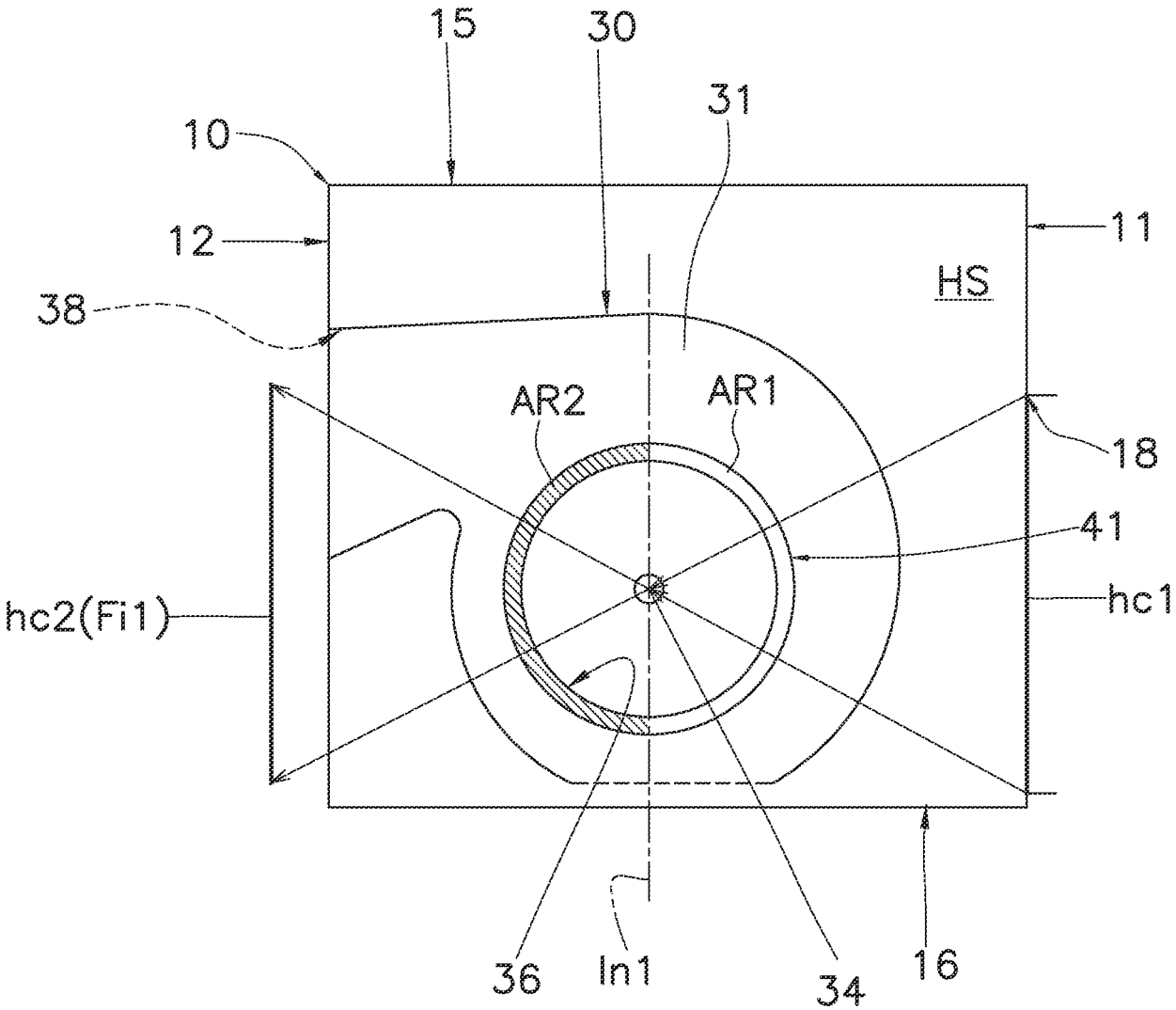
FIG. 8 is a schematic side view of the centrifugal fan, which illustrates a preferable placement position of the air flow volume detector.

As illustrated in FIG. 8, the first bell mouth 41 is dividable into a first region AR1 (not hatched with oblique lines) and a second region AR2 (hatched with oblique lines), with respect to the intake port 18 of the main body casing 10. Preferably, the probe 51 of the air flow volume detector 50 is located on the normal of the surface of the first bell mouth 41 in the second region AR2 where an air velocity is more stable.

FIG. 8 illustrates a virtual graphic Fi1 that is line symmetric with the intake port 18 of the main body casing 10 with respect to the shaft 34 defined as a symmetry axis. As illustrated in FIG. 3, the intake port 18 has a circular shape. The intake port 18 extends in parallel with the shaft 34. When the intake port 18 is seen from the third face 13 (see FIG. 3) of the centrifugal fan 30 along the axis of the shaft 34, a nearer semicircle hc1 to the third face 13 appears. FIG. 8 also illustrates a semicircle hc2 that is line symmetric with the semicircle hc1 with respect to the shaft 34 defined as the symmetry axis. The graphic Fi1 is a circular graphic that overlaps the intake port 18 when the intake port 18 turns on the shaft 34 by 180 degrees. The first region AR1 is nearer to the intake port 18, and the second region AR2 is nearer to the graphic Fi1. FIG. 8 also illustrates a straight line ln1 that passes the shaft 34 and the first bell mouth 41 and is equally separate from the intake port 18 and the graphic Fi1. The first region AR1 and the second region AR2 are described with respect to the straight line ln1. The first region AR1 is nearer to the intake port 18 than the straight line ln1 on the first bell mouth 41 is. The second region AR2 is nearer to the graphic Fi1 than the straight line ln1 on the first bell mouth 41 is.

According to the foregoing exemplary description on the placement position of the air flow volume detector 50, the air flow volume detector 50 is placed on the first bell mouth 41. Also in a case where the air flow volume detector 50 is placed on the second bell mouth 42, the air flow volume detector 50 is placed on the second bell mouth 42 in a manner similar to that in the case where the air flow volume detector 50 is placed on the first bell mouth 41. In the case where the air flow volume detector 50 is placed on the second bell mouth 42, the probe 51 of the air flow volume detector 50 is placed in a current of air that flows into the main body casing 10 through the intake port 18 and then flows into the centrifugal fan 30 through the second air inlet 37. In the case where the air flow volume detector 50 is placed on the second bell mouth 42, the main body 52 of the air flow volume detector 50 is fixed to the fan casing 31. Alternatively, the main body 52 may be fixed to the first bell mouth 41. Still alternatively, the main body 52 may be fixed to both the fan casing 31 and the first bell mouth 41.

(3) Relationship Between Air Velocity and Air Flow Volume

Figure 9:
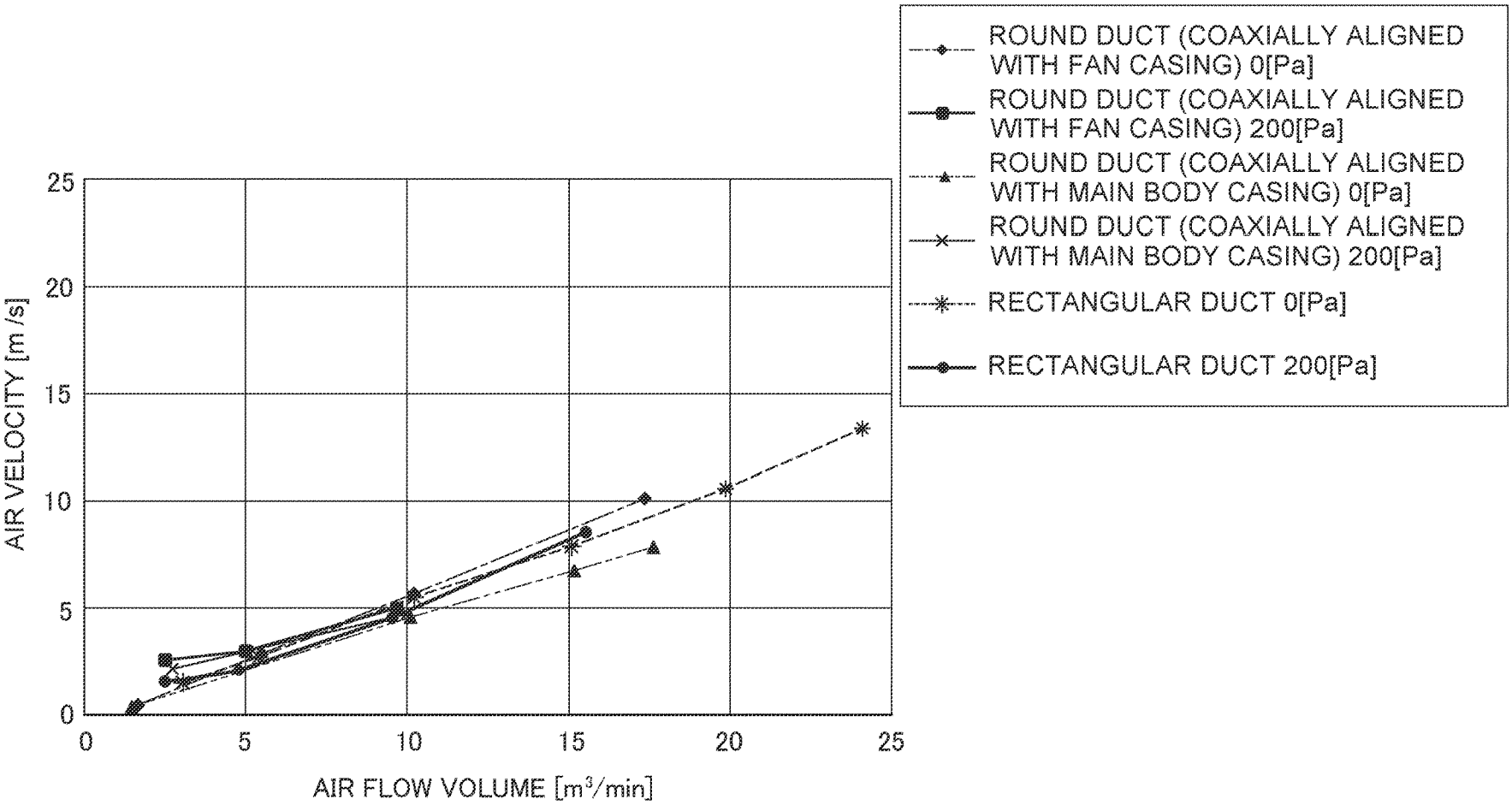
FIG. 9 is a graph of a relationship between an air velocity and an air flow volume detected by the air flow volume detector placed on a first bell mouth.
Figure 10:
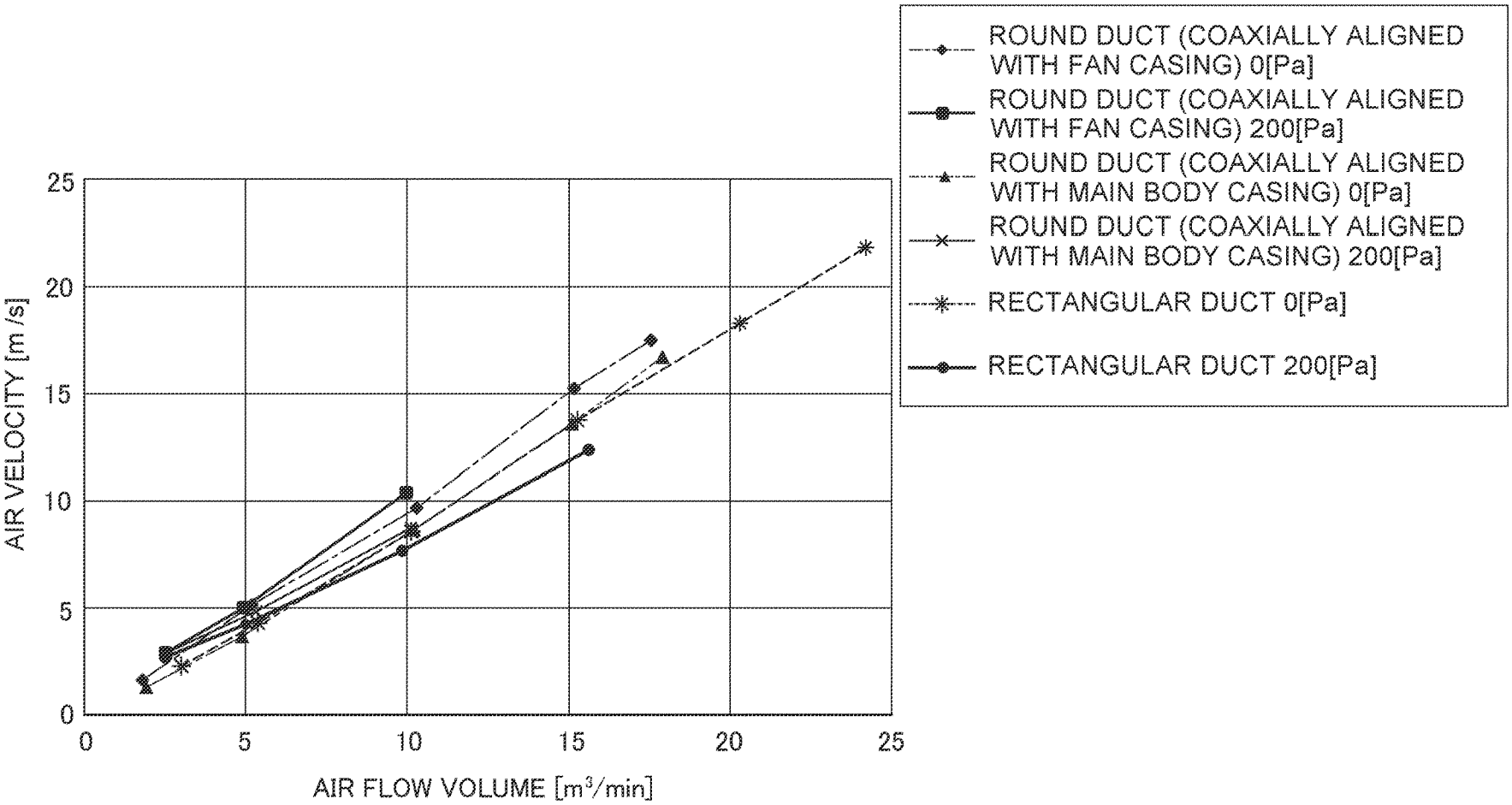
FIG. 10 is a graph of a relationship between an air velocity and an air flow volume detected by the air flow volume detector placed on a first surface of a fan casing.
Figure 11:
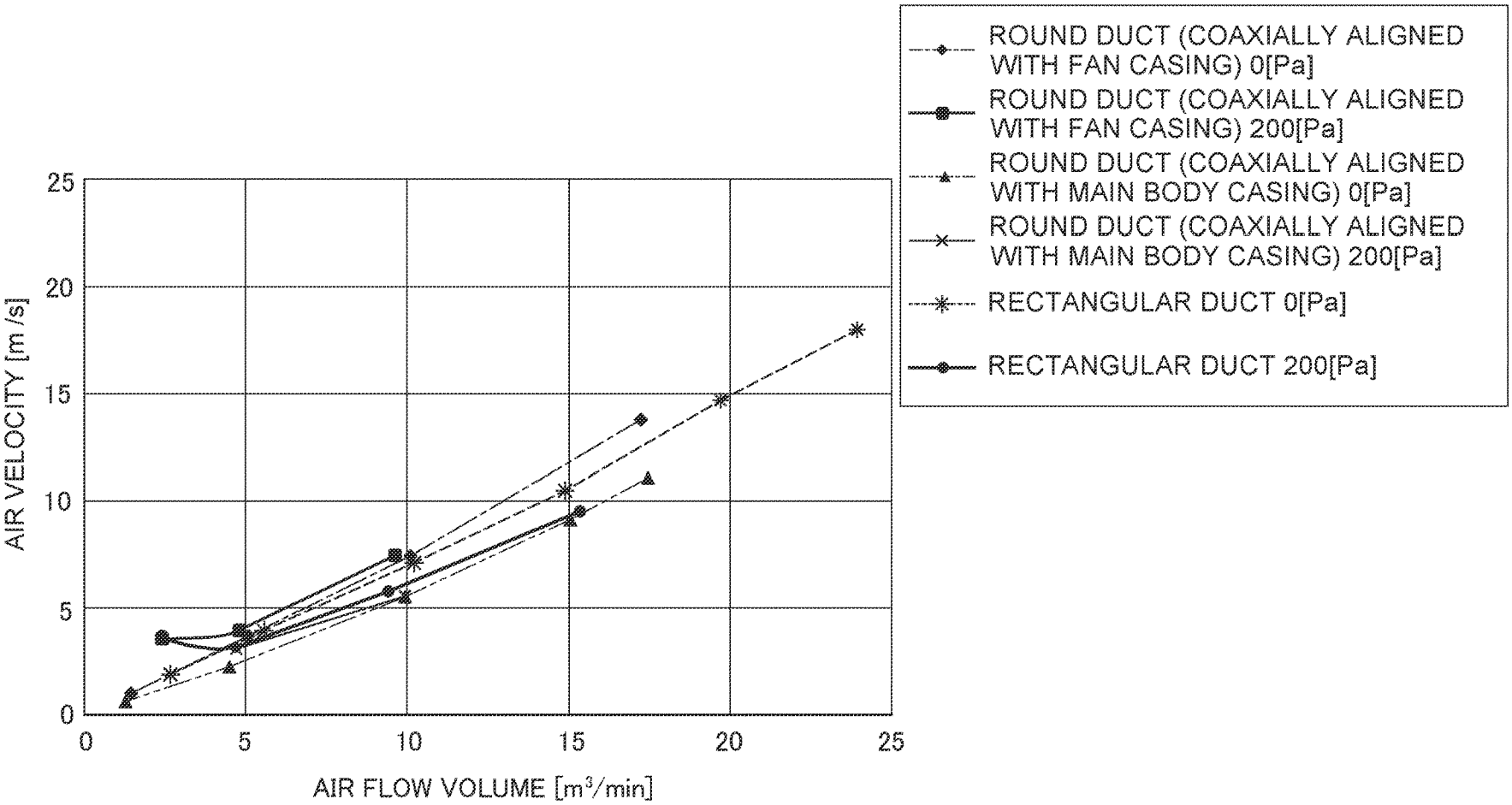
FIG. 11 is a graph of a relationship between an air velocity and an air flow volume detected by the air flow volume detector placed on a second bell mouth.
Figure 12:
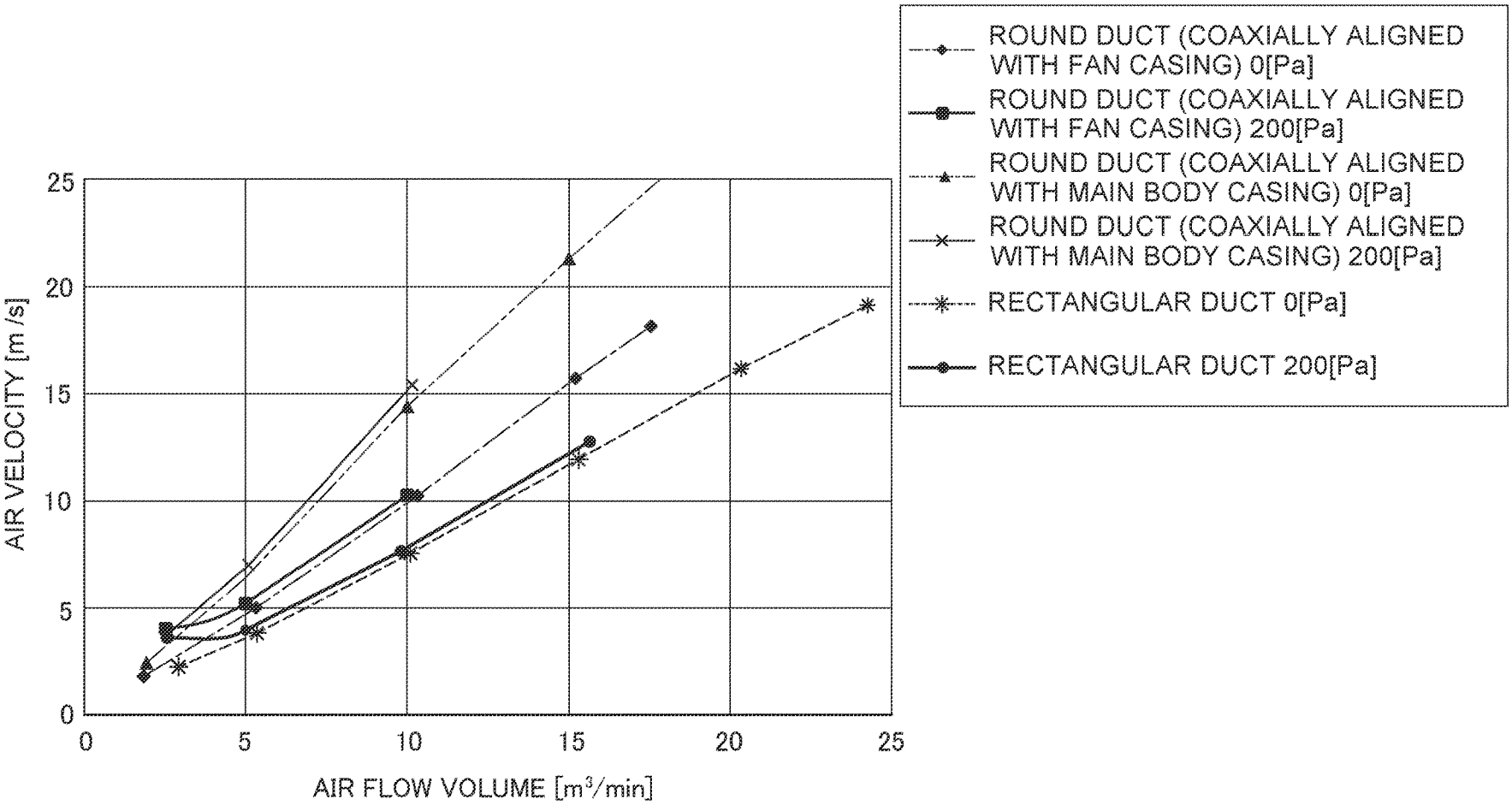
FIG. 12 is a graph of a relationship between an air velocity and an air flow volume detected by the air flow volume detector placed at another position of the second bell mouth.
Figure 13:
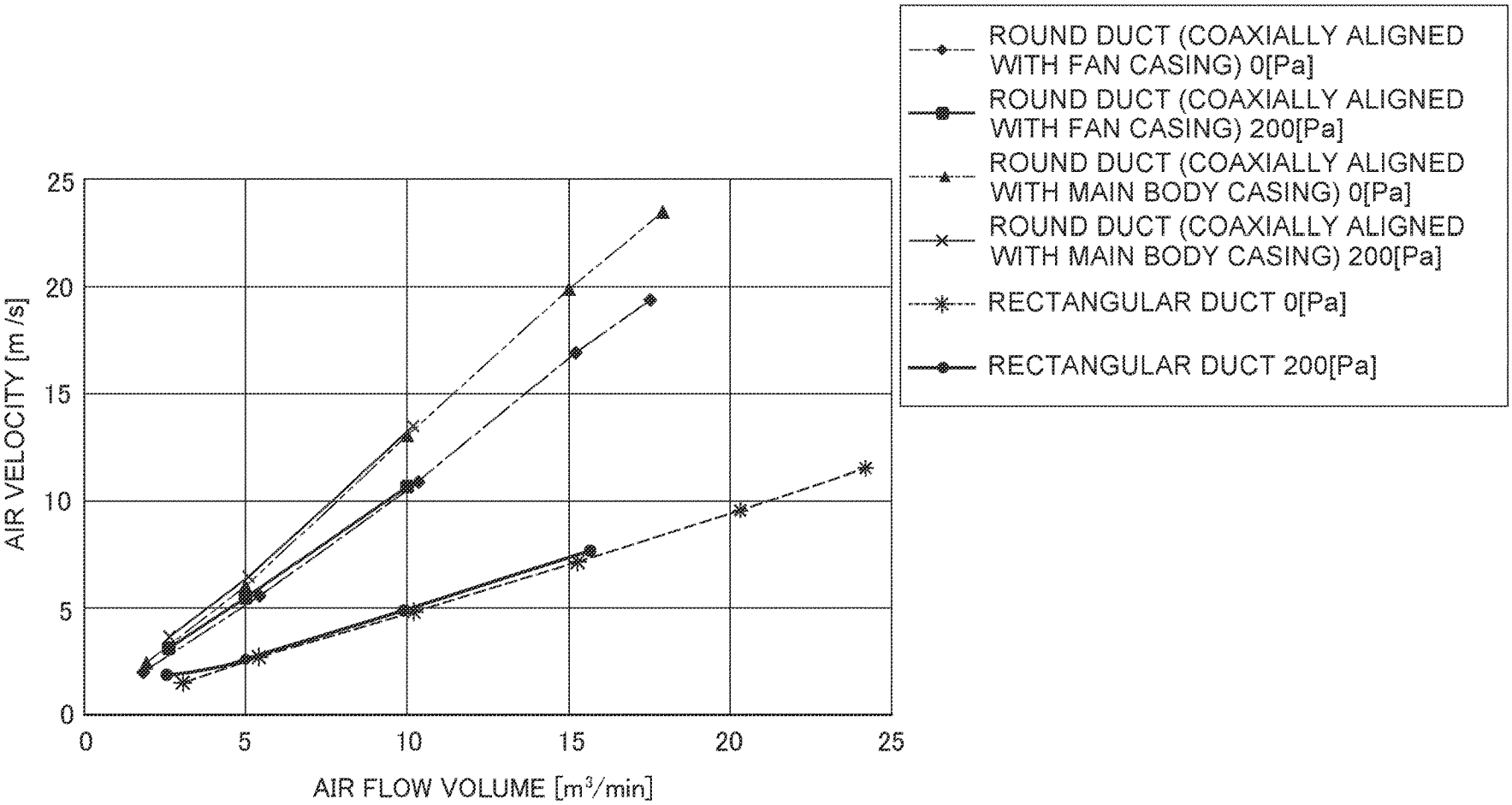
FIG. 13 is a graph of a relationship between an air velocity and an air flow volume detected by the air flow volume detector placed on a second surface of the fan casing.

FIGS. 9 to 13 illustrate relationships between an air velocity and an air flow volume measured with the air flow volume detector 50 mounted at different positions of the fan casing 31. FIG. 9 is a graph of the relationship between an air velocity and an air flow volume measured by the air flow volume detector 50 mounted at the foregoing position illustrated in FIG. 3. FIG. 10 is a graph of the relationship between an air velocity and an air flow volume measured by the air flow volume detector 50 mounted at a first spot SP1 illustrated in FIG. 4. FIG. 11 is a graph of the relationship between an air velocity and an air flow volume measured by the air flow volume detector 50 mounted at a second spot SP2 illustrated in FIG. 4. FIG. 12 is a graph of the relationship between an air velocity and an air flow volume measured by the air flow volume detector 50 mounted at a third spot SP3 illustrated in FIG. 3. FIG. 13 is a graph of the relationship between an air velocity and an air flow volume measured by the air flow volume detector 50 mounted at a fourth spot SP4 illustrated in FIG. 4. Each of the probe 51 of the air flow volume detector 50 mounted at the first spot SP1 in FIG. 4 and the probe 51 of the air flow volume detector 50 mounted at the second spot SP2 in FIG. 4 is placed in the measurement space MS, which is similar to the probe 51 of the air flow volume detector 50 illustrated in FIG. 3 in this respect.

The foregoing position of the air flow volume detector 50 illustrated in FIG. 3 is farthest from the intake port 18 in the first bell mouth 41. The first spot SP1 is nearest to the intake port 18 in the second bell mouth 42. The second spot SP2 is nearest to the fifth face 15 in the second bell mouth 42. The third spot SP3 is nearest to the intake port 18 in the first surface 31*a* of the fan casing 31. The fourth spot SP4 is nearest to the intake port 18 in a second surface 31*c* of the fan casing 31.

Measurements are made in a state in which the second duct 200 is removed, in order to obtain the graphs of FIGS. 9 to 13. The first duct 100 used for the measurements is a rectangular duct and a round duct each having a length L11 of 500 mm. The round duct has a diameter of 200 mm. The rectangular duct is equal in size to the first face 11 of the main body casing 10. In the case where the rectangular duct is used as the first duct 100, the portion corresponding to the first face 11 where the round duct is to be mounted is wholly open when the rectangular duct is removed. The main body casing 10 has a length L12 of 340 mm, a width L13 of 520 mm, and a height L14 of 300 mm. In each of the graphs of FIGS. 9 to 13, a chain line indicates a result of measurement made on conditions that the first duct 100 is the round duct, a static pressure outside the fan unit 1 is 0 Pa, and the round duct is coaxially aligned with the fan casing 31. A solid line combined with square plots indicates a result of measurement made on conditions that the first duct 100 is the round duct, a static pressure outside the fan unit 1 is 200 Pa, and the round duct is coaxially aligned with the fan casing 31. A chain double-dashed line combined with triangular plots indicates a result of measurement made on conditions that the first duct 100 is the round duct, a static pressure outside the fan unit 1 is 0 Pa, and the round duct is coaxially aligned with the main body casing 10. A solid line combined with "x" plots indicates a result of measurement made on conditions that the first duct 100 is the round duct, a static pressure outside the fan unit 1 is 200 Pa, and the round duct is coaxially aligned with the main body casing 10. A broken line combined with asterisk plots indicates a result of measurement made on conditions that the first duct 100 is the rectangular duct and a static pressure outside the fan unit 1 is 0 Pa. A solid line combined with circular plots indicates a result of measurement made on conditions that the first duct 100 is the rectangular duct and a static pressure outside the fan unit 1 is 200 Pa.

With reference to the graphs of FIGS. 9 to 11, the following can be found from a comparison between the case where the air flow volume detector 50 is placed on the first bell mouth 41 or the second bell mouth 42 and the case where the air flow volume detector 50 is located near the intake port 18 on the first surface 31*a* or second surface 31*c* of the fan casing 31, rather than the first bell mouth 41 and the second bell mouth 42. It is apparent from the graphs of FIGS. 9, 10, and 11 that the gradients of the respective lines are almost equal to one another in the case of the round duct and in the case of the rectangular duct. On the other hand, it is apparent from the graphs of FIGS. 12 and 13 that the gradients of the respective lines largely differ in the case of the round duct and in the case of the rectangular duct. Therefore, in the case where the air flow volume detector 50 is placed on the first bell mouth 41 or the second bell mouth 42, the relationship between the air velocity and the air flow volume is kept regardless of the shape of the intake port 18 (i.e., a sectional shape of the flow path in the first duct 100). In contrast to this, in the case where the air flow volume detector 50 is placed on the surface of the fan casing 31 far from the bell mouth, the relationship between the air velocity and the air flow volume is significantly affected by the shape of the intake port 18 (i.e., the sectional shape of the flow path in the first duct 100) as illustrated in FIGS. 12 and 13. Hence, the air flow volume detector 50 is fixed such that the probe 51 of the air flow volume detector 50 is placed in the measurement space MS of the first bell mouth 41 or second bell mouth 42. This configuration allows the fan unit 1 not to change conversion conditions from an air velocity into an air flow volume even when the sectional shape of the flow path in the first duct 100 is changed.

(4) Modifications (4-1) Modification A

Figure 14:
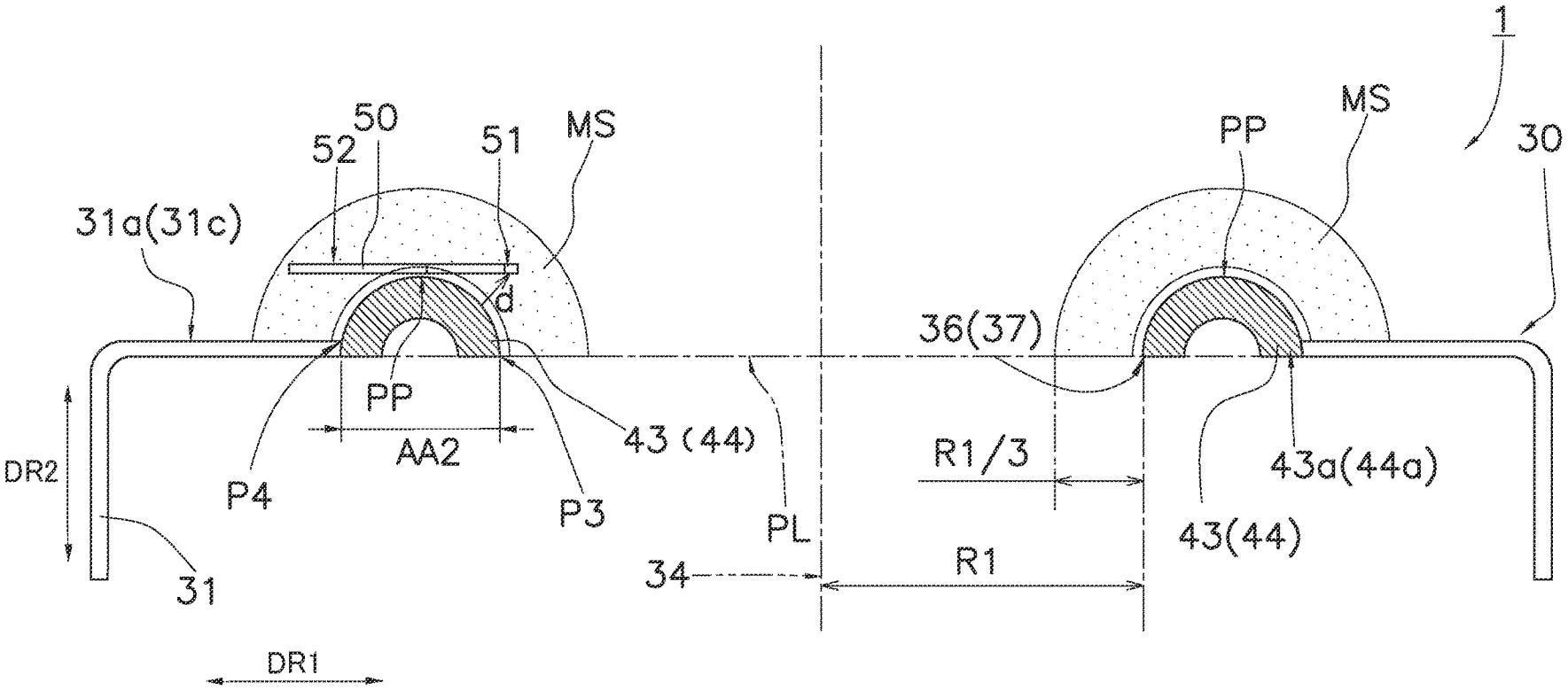
FIG. 14 is a schematic sectional view of a part of a centrifugal fan according to Modification A.

The foregoing embodiment concerns the case where the first bell mouth 41 and the second bell mouth 42 do not protrude from the first surface 31*a* and the second surface 31*c* of the fan casing 31, respectively, with reference to FIG. 7. As illustrated in FIG. 14, alternatively, a first bell mouth 43 and a second bell mouth 44 may protrude from a first surface 31*a* and a second surface 31*c* of a fan casing 31, respectively.

FIG. 14 illustrates the first bell mouth 43 (the second bell mouth 44) on which an air flow volume detector 50 is placed. FIG. 14 also illustrates a section of the first bell mouth 43 (the second bell mouth 44) taken along a plane covering a shaft 34. As illustrated in FIG. 14, the first bell mouth 43 (the second bell mouth 44) has a surface drawing a convex curve toward the shaft 34. More specifically, the surface of the first bell mouth 43 (the second bell mouth 44) draws a convex arc toward the shaft 34. As illustrated in FIG. 14, the surface of the first bell mouth 43 (the second bell mouth 44) protrudes outward of the fan casing 31 from the first surface 31*a* (the second surface 31*c*) of the fan casing 31 as a distance from the surface of the first bell mouth 43 (the second bell mouth 44) to the shaft 34 becomes smaller, reaches a top portion PP of the first bell mouth 43 (the second bell mouth 44), extends inward of the fan casing 31, and reaches a first air inlet 36 (a second air inlet 37).

A region AA2 has an outer side extending to a position P4 that is at a boundary between the surface of the first bell mouth 43 (the second bell mouth 44) and the first surface 31*a* of the fan casing 31, and an inner side extending to a position P3 illustrated in FIG. 14. In other words, the position P4 is on an outer periphery of the first bell mouth 43 (the second bell mouth 44). The position P3 is at a boundary between the surface of the first bell mouth 43 (the second bell mouth 44) and the first air inlet 36 (the second air inlet 37), and on an inner periphery of the surface of the first bell mouth 43 (the second bell mouth 44). As illustrated in FIG. 14, therefore, a measurement space MS is a donut-shaped space limited within a range from a position outward of the outer periphery of the first bell mouth 43 (the second bell mouth 44) by a length corresponding to one-third of a radius R1 of the first air inlet 36 (the second air inlet 37) to a position inward of the inner periphery of the first bell mouth 43 (the second bell mouth 44) by the length corresponding to one-third of the radius R1, as seen in a second direction DR2. The air flow volume detector 50 is placed such that a main body 52 at least partially overlaps the region AA2 as seen in the second direction DR2. It should be noted that the entire main body 52 may be fixed to the first surface 31*a* as long as a probe 51 is located in the measurement space MS.

The main body 52 is placed in the region AA2 since the probe 51 is placed in the measurement space MS as illustrated in FIG. 14. In FIG. 14, the measurement space MS is hatched with dots. The measurement space MS extends in the direction toward which the surface of the first bell mouth 43 (the second bell mouth 44) draws the convex curve, on a normal of the surface of the first bell mouth 43 (the second bell mouth 44). A given point in the measurement space MS has a distance d from the given point to the surface of the first bell mouth 43 (the second bell mouth 44), and the distance d is larger than 0 and smaller than one-third of the radius R1 of the first air inlet 36 (the second bell mouth 37). A second plane PL covers an inner face 43*a* (an inner face 44*a*) of the first bell mouth 43 (the second bell mouth 44) and extends perpendicularly to the shaft 34. The inner face 43*a* (the inner surface44*a*) of the first bell mouth 43 (the second bell mouth 44) belongs to an inner face of the fan casing 31 and is located within the region AA2. The measurement space MS extends within a range that covers a part of the second plane PL and is farther from a rotor 32 than from the second plane PL, as seen in a first direction DR1. A distance from a farther end edge of the measurement space MS from the rotor 32 to the top portion PP is shorter than a length corresponding to one-third of the radius R1 of the first air inlet 36 (the second air inlet 37), as seen in the first direction DR1. The measurement space MS is limited within a range corresponding to one-third of the radius R1 from the farther end edge of the measurement space MS from the shaft 34 to the boundary P4 between the surface of the first bell mouth 43 (the second bell mouth 44) and the fan casing 31, as seen in the second direction DR2. In addition, the measurement space MS is limited within a range corresponding to one-third of the radius toward the shaft 34 from a nearer end edge of the measurement space MS to the shaft 34 to the boundary P3 between the surface of the first bell mouth 43 (the second bell mouth 44) and the first air inlet 36 (the second air inlet 37), as seen in the second direction DR2. Furthermore, the measurement space MS is limited to a space separate from the first bell mouth 43 (the second bell mouth 44). This distance is, for example, 1 mm. Placing the probe 51 at a spot separate from the first bell mouth 43 (the second bell mouth 44) by 1 mm or more enables accurate conversion from an air velocity into an air flow volume. As illustrated in FIG. 14, the measurement space MS has a shape of two half rings in the vicinity of the first bell mouth 43 (the second bell mouth 44), as seen in the section taken along the plane covering the shaft 34.

The first bell mouth 43 (the second bell mouth 44) is also dividable into a first region AR1 and a second region AR2 with respect to an intake port 18 of a main body casing 10, which is similar to the first bell mouth 41 illustrated in FIG. 8 in this respect. Preferably, the air flow volume detector 50 is placed in the second region AR2 far from the intake port 18.

(4-2) Modification B

The foregoing embodiment concerns the case where the centrifugal fan 30 includes two air inlets, that is, the first air inlet 36 and the second air inlet 37. However, the centrifugal fan 30 is not limited to that including the first air inlet 36 and the second air inlet 37. For example, the technique of the foregoing embodiment is also applicable to a centrifugal fan including one air inlet.

(4-3) Modification C

The foregoing embodiment concerns the case where the main body casing 10 has the rectangular parallelepiped-base shape. However, the shape of the main body casing 10 is not limited to that described in the foregoing embodiment. For example, the main body casing 10 may have a cubic-base shape or a cylindrical-base shape.

(4-4) Modification D

The foregoing embodiment concerns the case where the fan motor 33 is placed in the housing space HS in the main body casing 10. The fan motor 33 may alternatively be placed outside the main body casing 10. The aspect that the centrifugal fan 30 is placed in the main body casing 10 also involves a case where the fan motor 33 is placed outside the main body casing 10 and the fan casing 31 is placed in the main body casing 10.

(5) Features (5-1)

The fan casing 31 includes the first bell mouth 41, 43 defining the first air inlet 36 through which air in the main body casing 10 flows into the fan casing 31, and the second bell mouth 42, 44 defining the second air inlet 37 through which air in the main body casing 10 flows into the fan casing 31. The main body 52 of the air flow volume detector 50 is fixed to at least one of the fan casing 31, the first bell mouth 41, 43, or the second bell mouth 42, 44. In the fan unit 1, a current of air is stable in the vicinity of the first bell mouth 41 and the second bell mouth 42. The probe 51 is located on the normal of the surface of at least one of the first bell mouth 41 or the second bell mouth 42 in the direction toward which the surface of at least one of the first bell mouth 41 or the second bell mouth 42 draws the convex curve. The probe 51 has the distance d from the probe 51 to the surface of at least one of the first bell mouth 41 or the second bell mouth 42, and the distance d is larger than 0 and smaller than one-third of the radius R1 of the first air inlet 36 or the second air inlet 37. The probe 51 placed at such a spot is capable of detecting an air flow volume-equivalent quantity in a stable current of air. Therefore, the air flow volume detector 50 including the probe 51 is capable of accurately detecting an air flow volume-equivalent quantity.

(5-2)

In the fan unit 1 illustrated in FIG. 7, the probe 51 is located on the normal of the surface of the first bell mouth 41 (the second bell mouth 42). In addition, the probe 51 has the distance d from the probe 51 to the surface of the first bell mouth 41 (the second bell mouth 42). The distance d is larger than 0 and smaller than one-third of the radius R1 of the first air inlet 36. The probe 51 is placed in the measurement space MS where a current of air is stable. The fan unit 1 including the probe 51 placed in the measurement space MS where a current of air is stable is capable of more accurately detecting an air flow volume-equivalent quantity, as compared with another fan unit including a probe 51 placed at a spot different from the measurement space MS.

(5-3)

In the fan unit 1 illustrated in FIG. 14, the probe 51 is located on the normal of the surface of the first bell mouth 43 (the second bell mouth 44). In addition, the probe 51 has the distance d from the probe 51 to the surface of the first bell mouth 43 (the second bell mouth 44). The distance d is larger than 0 and smaller than one-third of the radius R1 of the first air inlet 36. The probe 51 is placed in the measurement space MS where a current of air is stable. The fan unit 1 including the probe 51 placed in the measurement space MS where a current of air is stable is capable of more accurately detecting an air flow volume-equivalent quantity, as compared with another fan unit including a probe 51 placed at a spot different from the measurement space MS.

While various embodiments of the present disclosure have been described herein above, it is to be appreciated that various changes in form and detail may be made without departing from the spirit and scope of the present disclosure presently or hereafter claimed.

The invention claimed is:

1. A fan unit comprising:

a centrifugal fan including a fan casing, and a rotor disposed in the fan casing, the rotor being rotatable about a shaft;

an air flow volume detector including a main body, and a probe configured to detect an air flow volume equivalent quantity that is equivalent to an air flow volume to be provided by the centrifugal fan; and a main body casing housing the centrifugal fan and the air flow volume detector, the fan casing including a bell mouth defining an air inlet through which air in the main body casing flows into the fan casing, the bell mouth having a surface with a convex curve shape toward the shaft as seen in a section taken along a plane covering the shaft, the main body being fixed to at least one of the fan casing and the bell mouth, the probe being located on a normal of the surface of the bell mouth in a direction toward which the surface of the bell mouth protrudes, and a distance from the probe to the surface of the bell mouth being larger than 0 and smaller than one third of a radius of the air inlet, and the air flow volume detector including a thermal air velocity sensor configured to detect, as the air flow volume equivalent quantity, an air velocity of the air flowing through the air inlet not connected to a duct by measuring an amount of heat dissipated from the probe.

2. The fan unit according to claim 1, wherein the surface of the bell mouth extends inward of the fan casing from a surface of the fan casing as a distance from the surface of the bell mouth to the shaft becomes shorter, and reaches the air inlet.

3. The fan unit according to claim 2, wherein the main body casing has an intake port through which air flows into the main body casing, and the air flow volume detector is placed in a current of air flowing into the main body casing through the intake port and flowing into the centrifugal fan through the air inlet.

4. The fan unit according to claim 3, wherein in a virtual graphic that is line symmetric with the intake port of the main body casing with respect to the shaft defined as a symmetry axis, the bell mouth is divided into a first region near the intake port and a second region near the virtual graphic, and the air flow volume detector is placed in the second region.

5. The fan unit according to claim 1, wherein the surface of the bell mouth protrudes outward of the fan casing from a surface of the fan casing as a distance from the surface of the bell mouth to the shaft becomes shorter, reaches a top portion of the bell mouth, extends inward of the fan casing, and reaches the air inlet.

6. The fan unit according to claim 5, wherein the main body casing has an intake port through which air flows into the main body casing, and the air flow volume detector is placed in a current of air flowing into the main body casing through the intake port and flowing into the centrifugal fan through the air inlet.

7. The fan unit according to claim 6, wherein in a virtual graphic that is line symmetric with the intake port of the main body casing with respect to the shaft defined as a symmetry axis, the bell mouth is divided into a first region near the intake port and a second region near the virtual graphic, and the air flow volume detector is placed in the second region.

8. The fan unit according to claim 1, wherein the main body casing has an intake port through which air flows into the main body casing, and the air flow volume detector is placed in a current of air flowing into the main body casing through the intake port and flowing into the centrifugal fan through the air inlet.

9. The fan unit according to claim 8, wherein in a virtual graphic that is line symmetric with the intake port of the main body casing with respect to the shaft defined as a symmetry axis, the bell mouth is divided into a first region near the intake port and a second region near the virtual graphic, and the air flow volume detector is placed in the second region.

* * * * *